US007228575B2

(12) United States Patent
Chen

(10) Patent No.: US 7,228,575 B2
(45) Date of Patent: Jun. 12, 2007

(54) PLAYPEN ASSEMBLY

(75) Inventor: Shun-Min Chen, Taipei (TW)

(73) Assignee: Wonderland Nursery Goods Co., Ltd., Taipei (TW)

( * ) Notice: Subject to any disclaimer, the term of this patent is extended or adjusted under 35 U.S.C. 154(b) by 0 days.

(21) Appl. No.: 11/395,135

(22) Filed: Apr. 3, 2006

(65) Prior Publication Data

US 2006/0253979 A1 Nov. 16, 2006

(30) Foreign Application Priority Data

May 11, 2005 (CN) ..... 2005 2 0018456

(51) Int. Cl.
*A47D 7/00* (2006.01)

(52) U.S. Cl. ..... 5/93.2; 5/98.1; 5/98.3; 5/99.1

(58) Field of Classification Search ..... 5/97, 5/98.1, 98.3, 99.1, 93.2
See application file for complete search history.

(56) References Cited

U.S. PATENT DOCUMENTS 5,867,850 A * 2/1999 Mariol ..... 5/93.2
5,991,944 A * 11/1999 Yang ..... 5/99.1
6,192,535 B1 * 2/2001 Warner et al. ..... 5/93.1
6,430,762 B1 * 8/2002 Cheng ..... 5/93.2
6,539,563 B1 * 4/2003 Hsia ..... 5/93.2
6,634,038 B2 * 10/2003 Hsia ..... 5/95

* cited by examiner

*Primary Examiner*—Michael Trettel
(74) *Attorney, Agent, or Firm*—Pillsbury Winthrop Shaw Pittman, LLP

(57) ABSTRACT

A playpen assembly includes a playpen body having a plurality of horizontal support bars, and a hanging bed unit hung on the horizontal support bars and including a plurality of bed sections each having a plurality of sidewalls, a connecting portion interconnecting a top end of one of the sidewalls of one of the bed sections to a top end of one of the sidewalls of at least another one of the bed sections, and a reinforcing rod extending adjacent to the top ends of the bed sections and disposed beneath the connecting portion. The reinforcing rod bridges two opposite ones of the horizontal support bars, and has two opposite ends connected removably and respectively to the two opposite ones of the horizontal support bars.

20 Claims, 7 Drawing Sheets

PLAYPEN ASSEMBLY

CROSS-REFERENCE TO RELATED APPLICATION

This application claims priority of Chinese Application No. 200520018456.7, filed on May 11, 2005.

BACKGROUND OF THE INVENTION

1. Field of the Invention

The invention relates to an assembly, more particularly to a playpen assembly.

2. Description of the Related Art

Referring to FIG. 1, a conventional playpen assembly 100 includes a hanging bed unit 1 mounted removably on a top end of a playpen body 2. The playpen body 2 includes four vertical support rods 21, and four horizontal support rods 22 each disposed between two adjacent ones of the vertical support rods 21. The hanging bed unit 1 includes a rectangular bed body 11 made by sewing a woven material, and four extension portions 12 extending outwardly and respectively from four peripheral sides of the bed body 11. The hanging bed unit 1 is connected removably to the playpen body 2 through a plurality of snap fasteners 13. Each of the snap fasteners 13 includes a pair of male fasteners 131 provided respectively on ends of each two adjacent ones of the extension portions 12, and a pair of female fasteners 132 provided on each of the vertical support rods 21 for engaging releasably and respectively the male fasteners 131. The hanging bed unit 1 further includes a divider 14 to divide the hanging bed unit 1 into two receiving sections 111, 112 having different depths and areas.

The hanging bed unit 1 is hung on the top end of the playpen body 2 by interengaging the male and female fasteners 131, 132, and is disposed within a top receiving portion defined cooperatively by the vertical and horizontal support rods 21, 22. When the hanging bed unit 1 is not required, it can be removed from the playpen body 2 by disengaging the male and female fasteners 131, 132. The hanging bed unit 1 can be folded for storage after it is removed from the playpen body 2.

Although the aforementioned conventional playpen assembly 100 can achieve its intended purpose, since the hanging bed unit 1 depends only on the snap fasteners 13 for positioning on the playpen body 2 and has no support at a central portion thereof, when the hanging bed unit 1 bears a heavy weight, the snap fasteners 13 cannot stably support the hanging bed unit 1 on the playpen body 2. This makes the hanging bed unit 1 unsafe to use.

SUMMARY OF THE INVENTION

Therefore, the main object of the present invention is to provide a playpen assembly having a hanging bed unit which can be supported stably on a playpen body and which includes a first bed section for the lying of a baby therein, a second bed section for diaper changing, and a third bed section for storage of baby accessories.

According to one aspect of the present invention, a playpen assembly comprises a playpen body and a hanging bed unit. The playpen body includes a plurality of spaced-apart vertical support rods, and a plurality of horizontal support bars each connected between top ends of two adjacent ones of the vertical support rods. The hanging bed unit is hung on the horizontal support bars, and includes a plurality of bed sections each having a bottom wall and a plurality of sidewalls that cooperate with the bottom wall to define a receiving space, a connecting portion interconnecting a top end of one of the sidewalls of one of the bed sections to a top end of one of the sidewalls of at least another one of the bed sections, and a reinforcing rod extending adjacent to the top ends of the bed sections and disposed beneath the connecting portion. The reinforcing rod bridges two opposite ones of the horizontal support bars, and has two opposite ends connected removably and respectively to the two opposite ones of the horizontal support bars.

According to another aspect of the present invention, a hanging bed unit for a playpen body includes a plurality of horizontal support bars. The hanging bed unit comprises a plurality of bed sections, and a reinforcing rod. Each of the bed sections has a bottom wall, a plurality of sidewalls that cooperate with the bottom wall to define a receiving space, and a connecting portion interconnecting a top end of one of the sidewalls of one of the bed sections to a top end of one of the sidewalls of at least another one of the bed sections. The reinforcing rod extends adjacent to the top ends of the bed sections and is disposed beneath the connecting portion. The reinforcing rod is adapted to bridge two opposite ones of the horizontal support bars, and has two opposite ends adapted to be connected removably and respectively to the two opposite ones of the horizontal support bars.

According to yet another aspect of the present invention, a combined bassinet, diaper-changing table and storage assembly to be hung removably on a playpen comprises a unitary body which includes first, second and third bed sections, a connecting portion, and a reinforcing rod. Each of the first to third bed sections has a bottom wall, and first, second, third and fourth sidewalls. The connecting portion interconnects a top end of the fourth sidewall of the first bed section to top ends of the fourth sidewalls of the second and third bed sections. The reinforcing rod extends adjacent to the top ends of the first to third bed sections, and is disposed beneath the connecting portion. The reinforcing rod is adapted to bridge two opposite ones of horizontal support bars of the playpen, and has two opposite ends adapted to be connected removably and respectively to the two opposite ones of the horizontal support bars of the playpen. The fourth sidewalls of the second and third bed sections are adjacent to each other and to the fourth sidewall of the first bed section. The third sidewalls of the second and third bed sections are juxtaposed.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
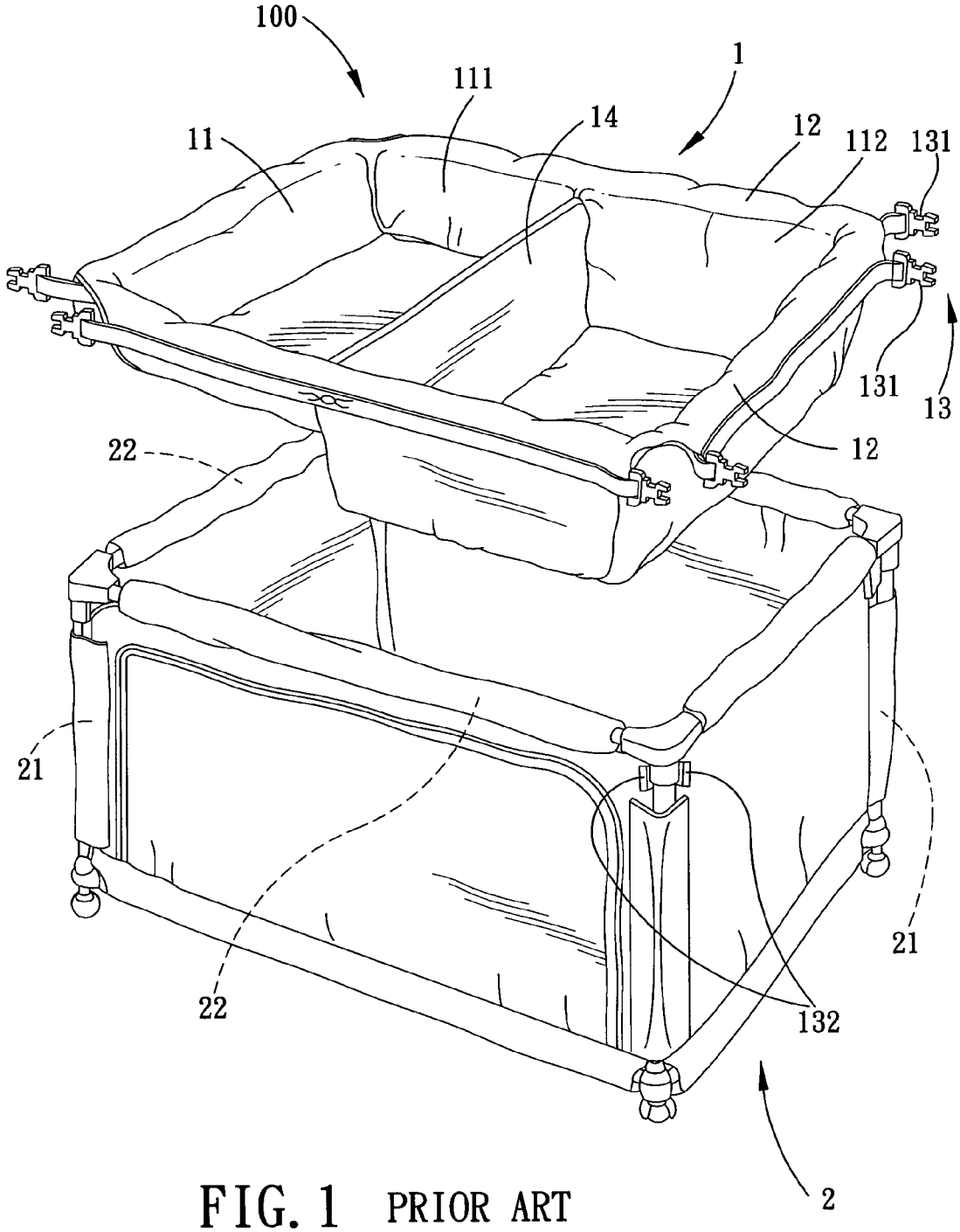
FIG. 1 PRIOR ART
FIG. 1 is an exploded perspective view of a conventional playpen assembly.
Figure 2:
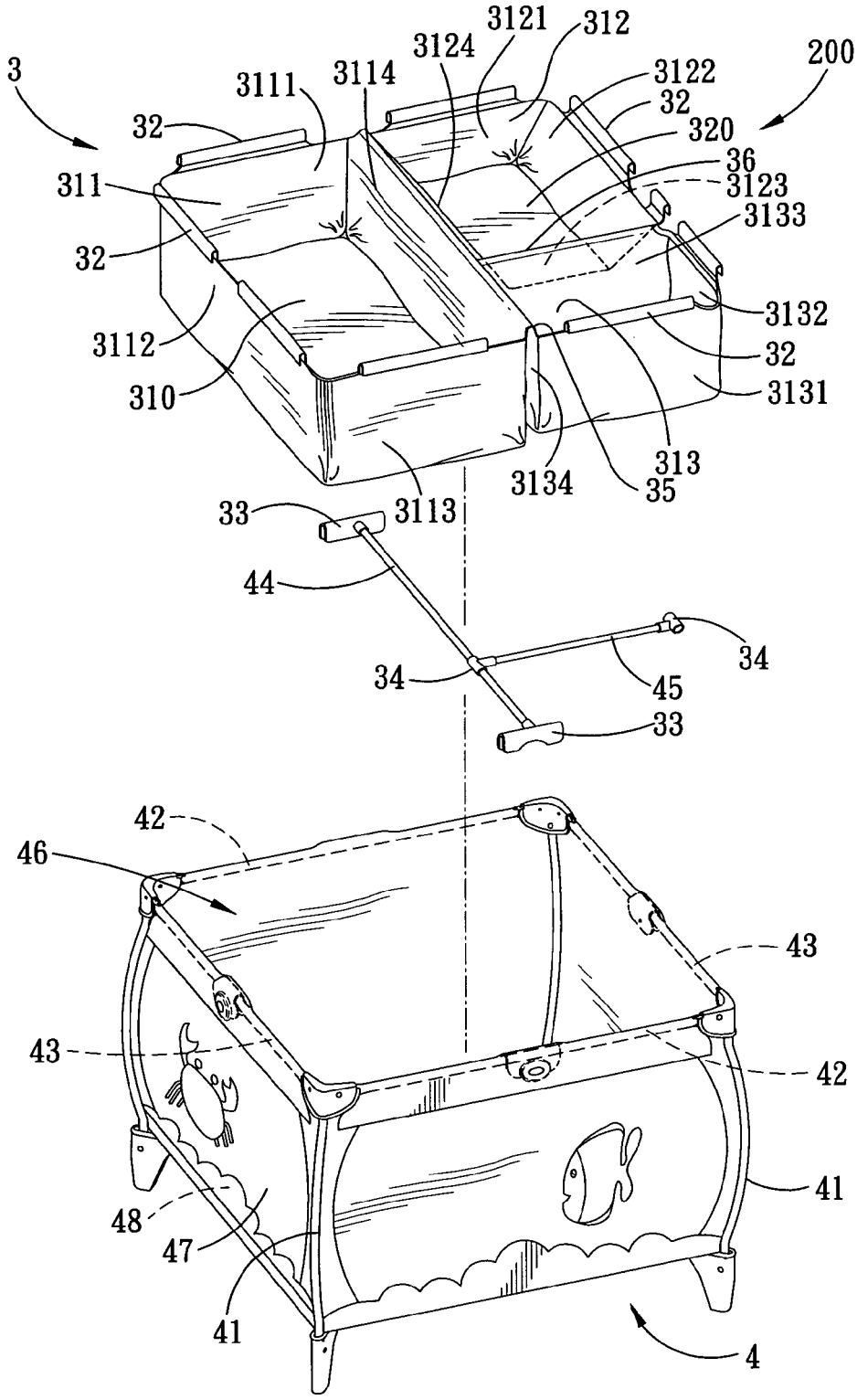
FIG. 2 is an exploded perspective view of the first preferred embodiment of a playpen assembly according to the present invention.
Figure 3:
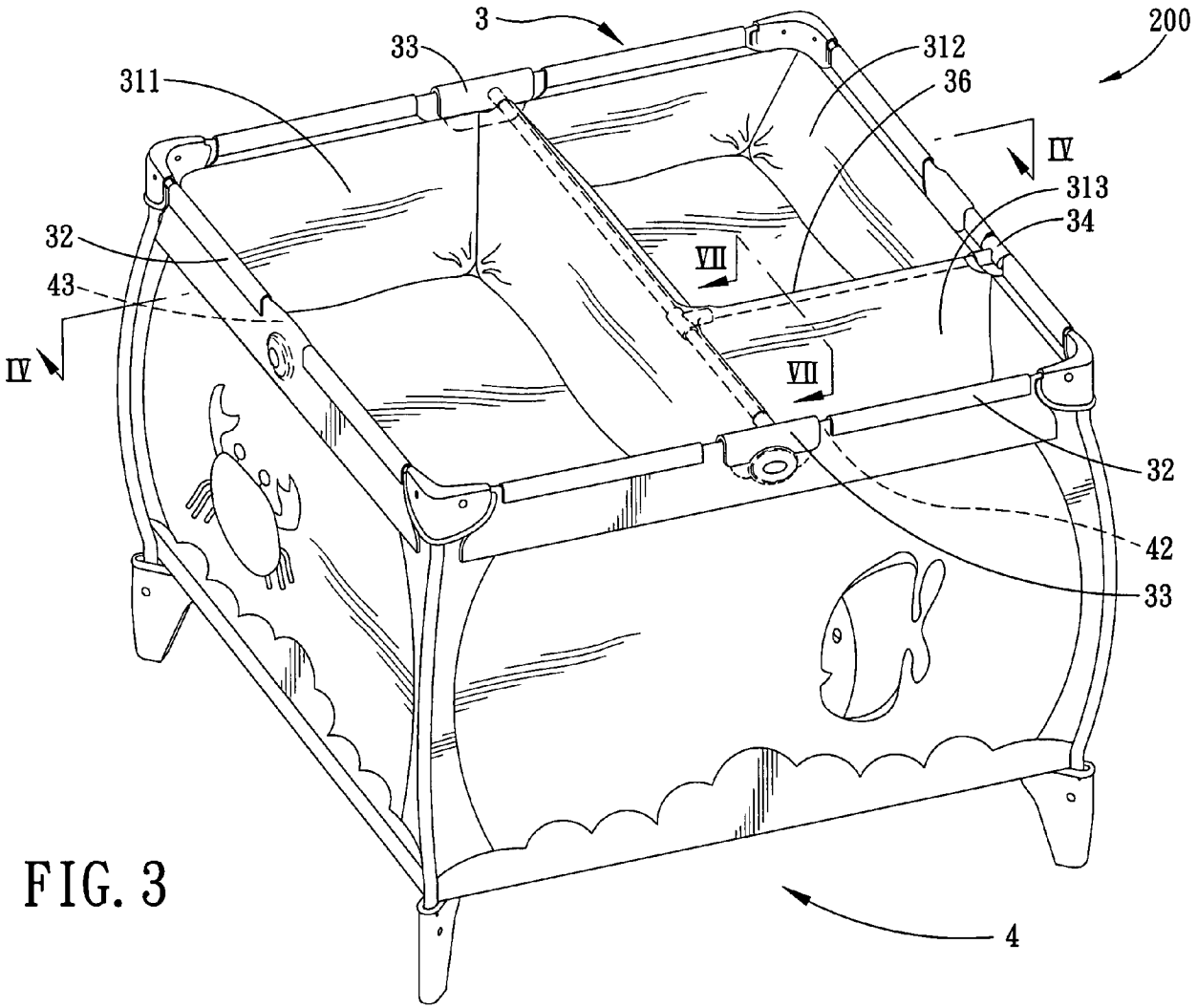
FIG. 3 is a perspective view of the first preferred embodiment in an assembled state.

Before the present invention is described in greater detail, it should be noted that like elements are denoted by the same reference numerals throughout the disclosure.

Referring to FIGS. 2 to 5, the first preferred embodiment of a playpen assembly 200 according to the present invention is shown to comprise a playpen body 4 and a hanging bed unit 3.

The playpen body 4 includes four spaced-apart curved vertical support rods 41, two opposite first horizontal support bars 42, and two opposite second horizontal support bars 43. Each of the first and second horizontal support bars 42, 43 is connected between top ends of two adjacent ones of the vertical support rods 41 through conventional connectors. The playpen body 4 further includes a bottom wall 48, and a surrounding wall 47 that cooperates with the bottom wall 48 to define a playing space 46 for a baby. The surrounding wall 47, in this embodiment, is made of a woven material. However, the surrounding wall 47 may be made of four wall plates.

Figure 4:
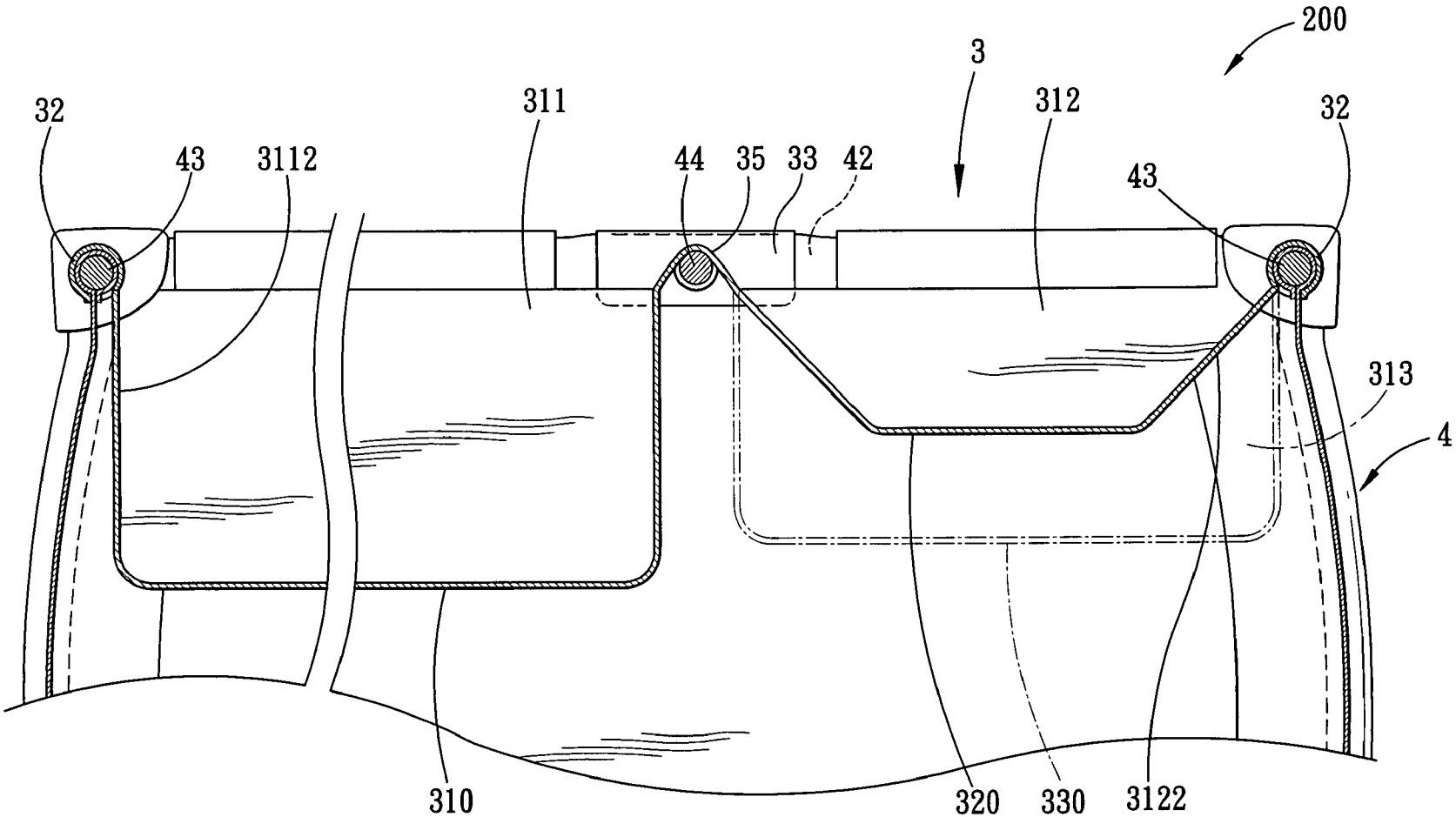
FIG. 4 is a fragmentary schematic view of the first preferred embodiment taken along line IV—IV of FIG. 3.
Figure 5:
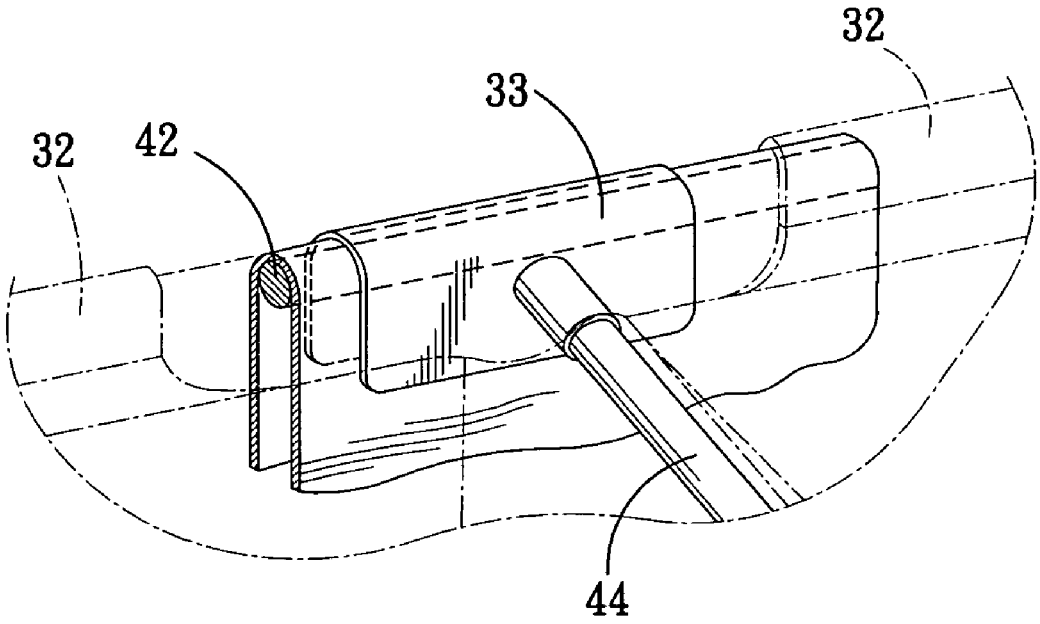
FIG. 5 is a fragmentary partly sectional view of the first preferred embodiment, illustrating how an end of a first reinforcing rod is attached to a horizontal support bar.

The hanging bed unit 3 is hung removably on the first and second horizontal support bars 42, 43, and includes first, second and third bed sections 311, 312, 313, a first connecting portion 35, and a rigid first reinforcing rod 44. The first, second and third bed sections 311, 312, 313 have different depths, as best illustrated in FIG. 4. The first bed section 311 has a bottom wall 310, and first, second, third and fourth sidewalls 3111, 3112, 3113, 3114 connected to four end peripheries of the bottom wall 310 and cooperating with the same to define a receiving space. The second bed section 312 has a bottom wall 320, and first, second, third and fourth sidewalls 3121, 3122, 3123, 3124 connected to four end peripheries of the bottom wall 320 and cooperating with the same to define a receiving space. The third bed section 313 has a bottom wall 330, and first, second, third and fourth side walls 3131, 3132, 3133, 3134 connected to four end peripheries of the bottom wall 330 and cooperating with the same to define a receiving space.

The fourth sidewalls 3124, 3134 of the second and third bed sections 312, 313 are adjacent to each other and are connected to the fourth sidewall 3114 of the first bed section 311. The third sidewalls 3123, 3133 of the second and third bed sections 312, 313 are juxtaposed. The first to third sidewalls 3111, 3112, 3113 of the first bed section 311 and the first and second sidewalls 3121, 3131, 3122, 3132 of the second and third bed sections 312, 313 have top ends provided with a plurality of first hook members 32 attached to the first and second horizontal support bars 42, 43. Each first hook member 32 is made of a plastic material, and has a curved cross section. Through resiliency of the material itself, the first hook members 32 can be clamped removably on the corresponding first and second horizontal support bars 42, 43.

The first connecting portion 35 connects a top end of the fourth sidewall 3114 of the first bed section 311 to top ends of the fourth sidewalls 3124, 3134 of the second and third bed sections 312, 313.

The first reinforcing rod 44 extends adjacent to the top ends of the fourth sidewalls 3114, 3124, 3134 of the first to third bed sections 311, 312, 313, and is disposed beneath the first connecting portion 35. The first reinforcing rod 44 bridges the first horizontal support bars 42, and has two opposite ends provided respectively with second hook members 33 that are connected removably and respectively to the first horizontal support bars 42. In this embodiment, the length of each of the first and second horizontal support bars 42, 43 and the length of the first reinforcing rod 44 are substantially the same.

The hanging bed unit 3 further includes a second connecting portion 36 and a second reinforcing member 45. The second connecting portion 36 interconnects top ends of the third sidewalls 3123, 3133 of the second and third bed sections 312, 313. In this embodiment, the second reinforcing member 45 is a rigid reinforcing rod that extends transversely from the first reinforcing rod 44 to one of the second horizontal support bars 43, and is disposed beneath the second connecting portion 36. The second reinforcing member or rod 45 has two opposite ends provided respectively with third hook members 34 connected removably and respectively to the first reinforcing rod 44 and said one of the second horizontal support bars 43.

When the hanging bed unit 3 is to be mounted on the playpen body 4, the first and second reinforcing rods 44, 45 are first clamped on the corresponding first and second horizontal support bars 42, 43, after which the first and second connecting portions 35, 36 are placed respectively on the first and second reinforcing rods 44, 45, and the first hook members 32 are clamped on the corresponding first and second horizontal support bars 42, 43. As a result, the first to third bed sections 311, 312, 313 are hung on the first and second horizontal support bars 42, 43 and within the receiving space 46.

To ensure stable mounting of the hanging bed unit 3 on the playpen body 4, the first hook members 32 on the first to third sidewalls 3111, 3112, 3113 of the first bed section 311 and the first and second sidewalls 3121, 3131, 3122, 3132 of the second and third bed sections 312, 313 are provided with sufficient resiliencies so as to clamp tightly and removably onto the first and second horizontal support bars 42, 43. FIG. 4 is a sectional view, illustrating how the first hook members 32 on the top ends of the second sidewalls 3112, 3122 of the first and second bed sections 311, 312 are clamped tightly on the corresponding second horizontal support bars 43.

The second hook members 33 are provided on the two opposite ends of the first reinforcing rod 44 so as to mount securely the first reinforcing rod 44 between the first horizontal support bars 42, and the third hook members 34 are provided on the two opposite ends of the second reinforcing rod 45 so as to mount securely the second reinforcing rod 45 between the first reinforcing rod 44 and one of the second horizontal support bars 43. With such a structure, the playpen body 4 is made more rigid and is prevented from tipping to one side, twisting, etc., when the playpen body 4 bears a heavy load.

Further, through the presence of the first and second connecting portions 35, 36, the fourth sidewalls 3114, 3124, 3134 of the first to third bed sections 311, 312, 313 and the third sidewalls 3123, 3133 of the second and third bed sections 312, 313 are supported on the corresponding first and second reinforcing rods 44, 45.

Therefore, through the first and second horizontal support bars 42, 43 that support four sides of the hanging bed unit 3, and through the first and second reinforcing rods 44, 45 that support a middle portion of the hanging bed unit 3, the hanging bed unit 3 of the present invention is stably supported on the playpen body 4, and is thus safe to use. This is in contrast to the relatively unstable configuration of the conventional hanging bed unit 1 (see FIG. 1).

It should be noted that each of the fourth sidewalls 3114, 3124, 3134 of the first to third bed sections 311, 312, 313 and the third sidewalls 3123, 3133 of the second and third bed sections 312, 313 can be sewn with a rigid material so as to fully isolate each bed section 311, 312, 313. The second bed section 312 is shallower than the first bed section 311 so as to facilitate diaper changing. The third bed section 313 may be used to store baby accessories, such as diapers, milk bottles, milk powder, etc. Since the first to third bed sections 311, 312, 313 are not in spatial communication with one another, when the baby is seated or laid on the first bed section 311, there is no way for the baby to reach into the third bed section 313 and handle the accessories placed therein. Hence, the hanging bed unit 3 is safe and convenient to use.

Figure 6:
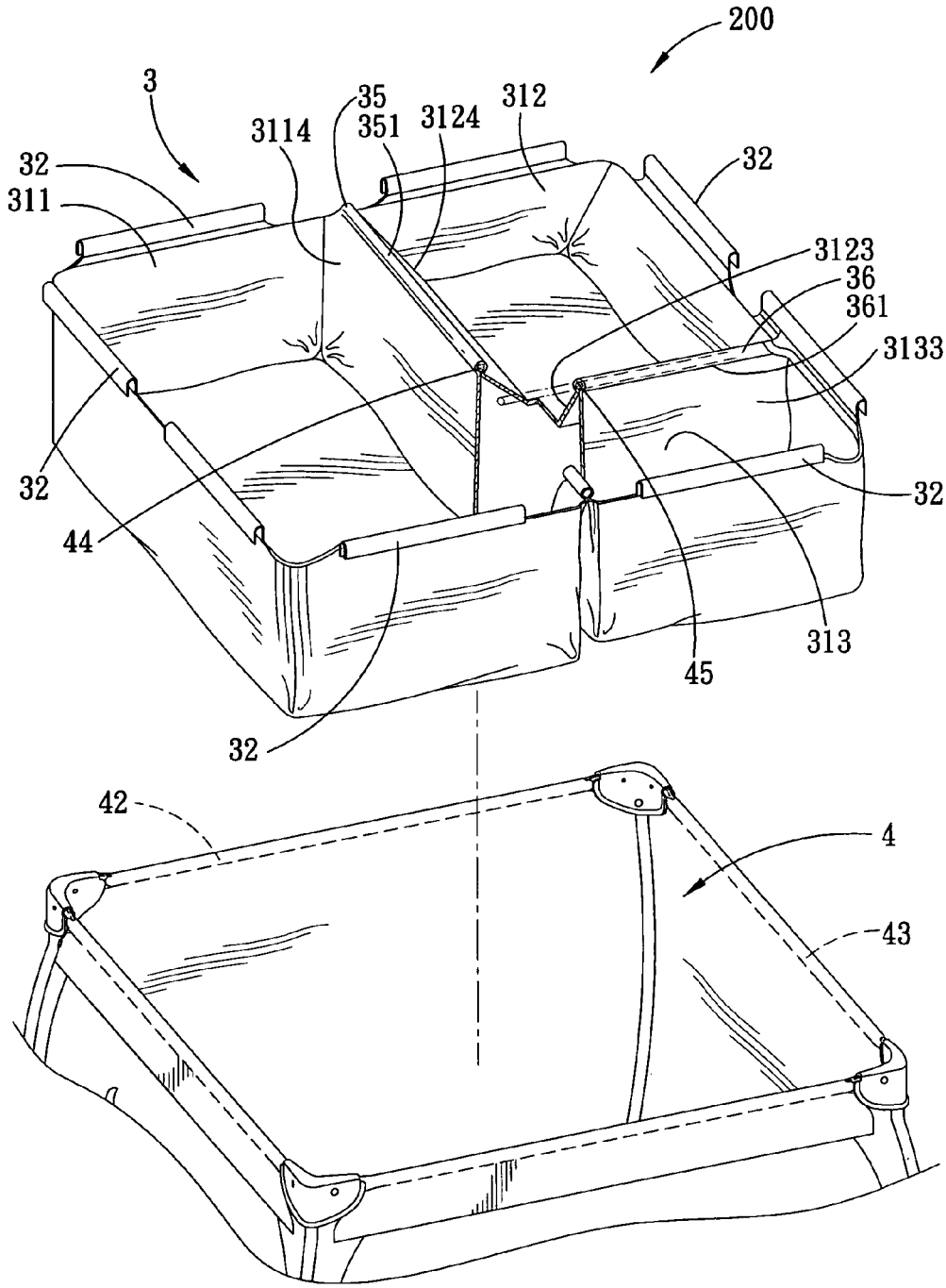
FIG. 6 is a fragmentary exploded perspective view of the second preferred embodiment of a playpen assembly according to the present invention.

Referring to FIG. 6, the second preferred embodiment of a playpen assembly 200 according to the present invention is shown to be similar to the first preferred embodiment. Particularly, the playpen assembly 200 includes a playpen body 4 and a hanging bed unit 3. However, in this embodiment, the first connecting portion 35 is sewn so as to include a first sleeve 351 connected to the top ends of the fourth sidewalls 3114, 3124, 3134 (see FIG. 2) of the first to third bed sections 311, 312, 313, and the first reinforcing rod 44 is inserted into the first sleeve 351. The second connecting portion 36 is sewn so as to include a second sleeve 361 connected to the top ends of the third sidewalls 3123, 3133 of the second and third bed sections 312, 313, and the second reinforcing member 45 is inserted into the second sleeve 361. In this embodiment, the second reinforcing member 45 is made of plastic steel. The hanging bed unit 3 is directly mounted on the playpen body 4 through the first hook members 32 which are attached to the first and second horizontal support bars 42, 43 of the playpen body 4.

Figure 7:
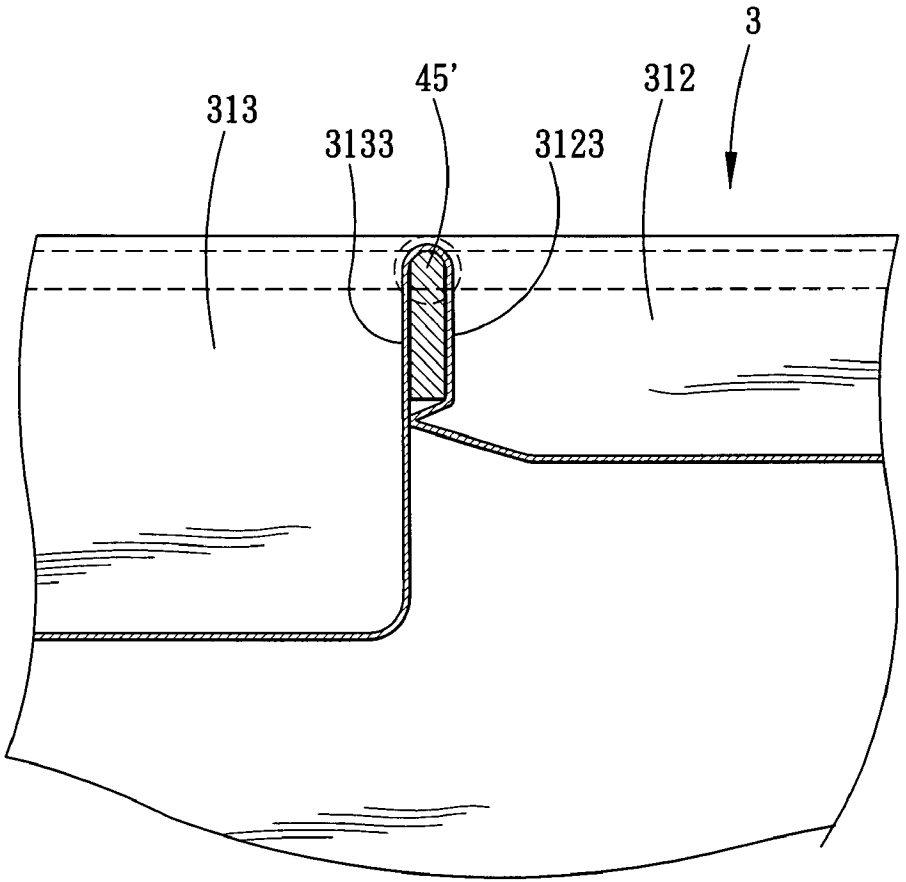
FIG. 7 is a fragmentary sectional view of the third preferred embodiment of a playpen assembly according to the present invention.

Referring to FIG. 7, the third preferred embodiment of a playpen assembly 200 according to the present invention is shown to be similar to the second preferred embodiment. However, in this embodiment, the second reinforcing member 45' is a hard plate inserted into the second sleeve 361 of the second connecting portion 36.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A playpen assembly comprising:

a playpen body including a plurality of spaced-apart vertical support rods, and a plurality of horizontal support bars each connected between top ends of two adjacent ones of said vertical support rods; and a hanging bed unit hung on said horizontal support bars, and including a plurality of bed sections each having a bottom wall and a plurality of sidewalls that cooperate with said bottom wall to define a receiving space, a first connecting portion interconnecting a top end of one of said sidewalls of one of said bed sections to a top end of one of said sidewalls of at least another one of said bed sections, and a first reinforcing rod extending adjacent to said top ends of said bed sections and disposed beneath said first connecting portion, said first reinforcing rod bridging two opposite ones of said horizontal support bars and having two opposite ends connected removably and respectively to said two opposite ones of said horizontal support bars.

2. The playpen assembly of claim 1, wherein said two opposite ends of said first reinforcing rod are provided with hook members which are attached to said horizontal support bars.

3. The playpen assembly of claim 2, wherein said hanging bed unit further includes a second reinforcing member extending transversely from said first reinforcing rod to one of said horizontal support bars that is substantially parallel to said first reinforcing rod.

4. The playpen assembly of claim 3, wherein said second reinforcing member has two opposite ends connected removably and respectively to said first reinforcing rod and said one of said horizontal support bars.

5. The playpen assembly of claim 4, wherein said two opposite ends of said second reinforcing member are provided with hook members which are attached respectively to said first reinforcing rod and said one of said horizontal support bars.

6. The playpen assembly of claim 3, wherein said bed sections include first, second and third bed sections, said sidewalls of each of said first to third bed sections having first, second, third and fourth sidewalls, said fourth sidewalls of said second and third bed sections being adjacent to each other and to said fourth sidewall of said first bed section, said third sidewalls of said second and third bed sections being juxtaposed.

7. The playpen assembly of claim 6, wherein said first connecting portion connects a top end of said fourth sidewall of said first bed section to top ends of said fourth sidewalls of said second and third bed sections, said first to third sidewalls of said first bed section and said first and second sidewalls of said second and third bed sections having top ends provided with a plurality of hook members attached to said horizontal support bars.

8. The playpen assembly of claim 6, wherein said hanging bed unit further includes a second connecting portion interconnecting top ends of said third sidewalls of said second and third bed sections, said second reinforcing member being disposed beneath said second connecting portion.

9. The playpen assembly of claim 6, wherein said first, second and third bed sections have different depths.

10. The playpen assembly of claim 6, wherein said first connecting portion includes a sleeve connected to said top ends of said fourth sidewalls of said first, second and third said bed sections, said first reinforcing rod being inserted into said sleeve.

11. The playpen assembly of claim 8, wherein said second connecting portion includes a sleeve connected to said top ends of said third sidewalls of said second and third bed sections, said second reinforcing member being inserted into said sleeve of said second connecting portion.

12. A hanging bed unit for a playpen body including a plurality of horizontal support bars, said hanging bed unit comprising:

a plurality of bed sections each having a bottom wall, a plurality of sidewalls that cooperate with said bottom wall to define a receiving space, and a first connecting portion interconnecting a top end of one of said sidewalls of one of said bed sections to a top end of one of said sidewalls of at least another one of said bed sections; and a first reinforcing rod extending adjacent to said top ends of said bed sections and disposed beneath said first connecting portion, said first reinforcing rod being adapted to bridge two opposite ones of the horizontal support bars and having two opposite ends adapted to be connected removably and respectively to the two opposite ones of the horizontal support bars.

13. The hanging bed unit of claim 12, wherein said two opposite ends of said first reinforcing rod are provided with hook members which are adapted to be attached to said horizontal support bars.

14. The hanging bed unit of claim 13, further comprising a second reinforcing member extending transversely from said first reinforcing rod to one of said horizontal support bars that is substantially parallel to said first reinforcing rod.

15. The hanging bed unit of claim 14, wherein said second reinforcing member has one end connected removably to said first reinforcing rod, and the other end adapted to be connected removably to one of the horizontal support bars.

16. The hanging bed unit of claim 15, wherein said two opposite ends of said second reinforcing member are provided with hook members.

17. The hanging bed unit of claim 14, wherein said bed sections include first, second and third bed sections, said sidewalls of each of said first to third bed sections having first, second, third and fourth sidewalls, said fourth sidewalls of said second and third bed sections being adjacent to each other and to said fourth sidewall of said first bed section, said third sidewalls of said second and third bed sections being juxtaposed.

18. A combined bassinet, diaper-changing table and storage assembly to be hung removably on a playpen, comprising a unitary body which includes first, second and third bed sections, each of said first to third bed sections having a bottom wall, and first, second, third and fourth sidewalls, a first connecting portion interconnecting a top end of said fourth sidewall of said first bed section to top ends of said fourth sidewalls of said second and third bed sections, and a first reinforcing rod extending adjacent to said top ends of said first to third bed sections and disposed beneath said first connecting portion, said first reinforcing rod being adapted to bridge two opposite ones of horizontal support bars of the playpen and having two opposite ends adapted to be connected removably and respectively to the two opposite ones of the horizontal support bars of the playpen, said fourth sidewalls of said second and third bed sections being adjacent to each other and to said fourth sidewall of said first bed section, said third sidewalls of said second and third bed sections being juxtaposed.

19. The combined bassinet, diaper-changing table and storage assembly of claim 18, wherein said first to third sidewalls of said first bed section and said first and second sidewalls of said second and third bed sections have top ends provided with a plurality of hook members adapted to be attached to the horizontal support bars of the playpen.

20. The combined bassinet, diaper-changing table and storage assembly of claim 18, wherein said first, second and third bed sections have different depths.

* * * * *